US010773119B2

(12) United States Patent
Cheng

(10) Patent No.: US 10,773,119 B2
(45) Date of Patent: Sep. 15, 2020

(54) EXERCISE SLIDER

(71) Applicant: SHANQ DIH CO., LTD., Tainan (TW)

(72) Inventor: Cheng-Kuo Cheng, Tainan (TW)

(73) Assignee: Shanq Dih Co., Ltd., Tainan (TW)

( * ) Notice: Subject to any disclaimer, the term of this patent is extended or adjusted under 35 U.S.C. 154(b) by 104 days.

(21) Appl. No.: 16/118,743

(22) Filed: Aug. 31, 2018

(65) Prior Publication Data

US 2020/0069996 A1 Mar. 5, 2020

(51) Int. Cl.
*A63B 21/00* (2006.01)
*A63B 23/12* (2006.01)
*A63B 22/20* (2006.01)

(52) U.S. Cl.
CPC ..... *A63B 21/4035* (2015.10); *A63B 22/203* (2013.01); *A63B 23/1236* (2013.01); *A63B 2208/0219* (2013.01); *A63B 2209/10* (2013.01); *A63B 2210/10* (2013.01); *A63B 2210/50* (2013.01)

(58) Field of Classification Search
CPC ..... A63B 21/4035; A63B 23/1236; A63B 22/203; A63B 2210/50; A63B 2208/0219; A63B 2210/10; A63B 2209/10
See application file for complete search history.

(56) References Cited

U.S. PATENT DOCUMENTS

2005/0245372 A1* 11/2005 Mylrea ..... A63B 21/0004 482/148
2006/0014615 A1* 1/2006 Godbold ..... A63B 21/00047 482/141
2010/0317496 A1* 12/2010 Abranchess ..... A63B 21/0004 482/141
2012/0083396 A1* 4/2012 Aquino ..... A63B 21/0004 482/131
2013/0252791 A1* 9/2013 Chang ..... A63B 22/20 482/132
2014/0100090 A1* 4/2014 Lima ..... A63B 23/1236 482/139
2014/0135189 A1* 5/2014 Thomason ..... A63B 23/1236 482/141
2015/0224356 A1* 8/2015 Holland ..... A63B 22/20 482/66
2015/0375027 A1* 12/2015 Neal ..... A63B 23/1236 482/91
2017/0189739 A1* 7/2017 Ressler, III ..... A63B 21/0004
2018/0043213 A1* 2/2018 Poeschl ..... A63B 26/00

* cited by examiner

*Primary Examiner* — Sundhara M Ganesan
(74) *Attorney, Agent, or Firm* — Rosenberg, Klein & Lee

(57) ABSTRACT

An exercise slider is disclosed, comprising a disc body having a smooth surface, a rough surface opposite to the smooth surface, and two assembly holes, and a handgrip detachably connected to the two assembly holes of the disc body by two terminals thereof respectively.

8 Claims, 10 Drawing Sheets

EXERCISE SLIDER

BACKGROUND OF THE INVENTION

1. Field of the Invention

The present invention relates to an exercise slider which is small and convenient in storage and provides various training modes so as to achieve effects of building muscle and burning calories.

2. Description of Related Art

In modern society, people spend a lot of time sitting on chairs for working or dealing with personal affairs. However, people usually have healthy problems such as overweight, sore shoulder and neck and physical functional decline due to sedentary, lacking of exercise and incorrect posture.

According to some research reports, exercise is the best way to maintain or enhance health and physical functions. To enhance exercising efficiency, many kinds of exercise equipment are provided nowadays such as treadmills, weightlifting bed frames, sit-up benches and exercise bikes. However, there is only one function for one kind of exercise equipment at present, so a user has to buy different kinds of exercise equipment to achieve comprehensive training effects. In addition, the present exercise equipment takes up space and is difficult in storage due to its large size; thus buying different kinds of exercise equipment by the user leads to a financial burden and a space occupied problem, and increases difficulties and troubles in use.

SUMMARY OF THE INVENTION

The exercise slider of the present invention is small in size and convenient in storage and provides various training modes so as to achieve effects of building muscle and burning calories.

The exercise slider of the present invention mainly comprises a disc body and a handgrip. The disc body has a smooth surface on one side, a rough surface on the other side, and two assembly holes respectively disposed on the smooth surface and the rough surface for corresponding to each other.

The handgrip is detachably connected to the two assembly holes of the disc body by two terminals of the handgrip respectively.

According to an embodiment of the present invention, the disc body comprises a first end surface defined as the smooth surface, a second end surface opposite to the first end surface, a first recess on the second end surface, the two assembly holes disposed at a bottom of the first recess for passing through the first end surface, a rough disc having two through holes corresponding to the two assembly holes of the disc body for assembling to the first recess on the second end surface to form the rough surface.

According to an embodiment of the present invention, the first recess of the disc body is provided with a protruding rim along a periphery of each of the two assembly holes at the bottom thereof for correspondingly assembling to each of the two through holes of the rough disc.

According to an embodiment of the present invention, each of the two assembly holes of the disc body is provided with plural positioning blocks on a wall thereof, and each of the two terminals of the handgrip is provided with plural positioning concave portions along a periphery thereof for respectively engaging with the plural positioning blocks for positioning.

According to an embodiment of the present invention, each of the two terminals of the handgrip is further provided with an anti-slip mat.

According to an embodiment of the present invention, the anti-slip mat at each of the two terminals of the handgrip is provided with plural positioning concave portions along a periphery thereof, and each of the two assembly holes of the disc body is provided with plural positioning blocks on a wall thereof for respectively engaging with the plural positioning concave portions of the anti-slip mat for positioning.

According to an embodiment of the present invention, each of the two terminals of the handgrip is provided with a second recess, a protruding margin formed on a periphery of the second recess, plural locking columns disposed at a bottom of the second recess and each having a first locking hole at a center, two anti-slip mats, a fixing sheet having plural second locking holes, and plural locking members. The anti-slip mat has a first surface, a second surface opposite to the first surface, an engaging groove disposed along a periphery of the first surface for correspondingly engaging with the protruding margin of the handgrip, a fixing recess disposed on the second surface for accommodating the fixing sheet, and plural third locking holes at a bottom of the fixing recess for corresponding to the plural second locking holes of the fixing sheet. Each of the plural locking members passes through one of the second locking holes of the fixing sheet and one of the third locking holes of the anti-slip mat for locking to the first locking hole of each of the plural locking columns respectively to fix the anti-slip mat to each of the two terminals of the handgrip.

According to an embodiment of the present invention, the protruding margin on each of the two terminals of the handgrip is provided with plural engaging concave portions, and the anti-slip mat is provided with plural engaging protruding portions in the engaging groove of the first surface to engage with the plural engaging concave portions of the protruding margin.

According to an embodiment of the present invention, the disc body is provided with a first connecting portion and a second connecting portion respectively on at least two corresponding laterals. The first connecting portion has at least one mortise and the second connection portion has at least one tenon for correspondingly engaging with the at least one mortise.

According to an embodiment of the present invention, the handgrip has an arched shape and an anti-slip portion in its middle.

In use of the present invention, the smooth surface or the rough surface of the present invention is attached to a floor according to a status of the floor to generate friction in need, and the present invention is then placed under a user's hands or feet to exercise by sliding on the floor. Accordingly, effects of building muscle and burning calories are achieved.

DETAILED DESCRIPTION OF THE PREFERRED EMBODIMENT

Figure 1:
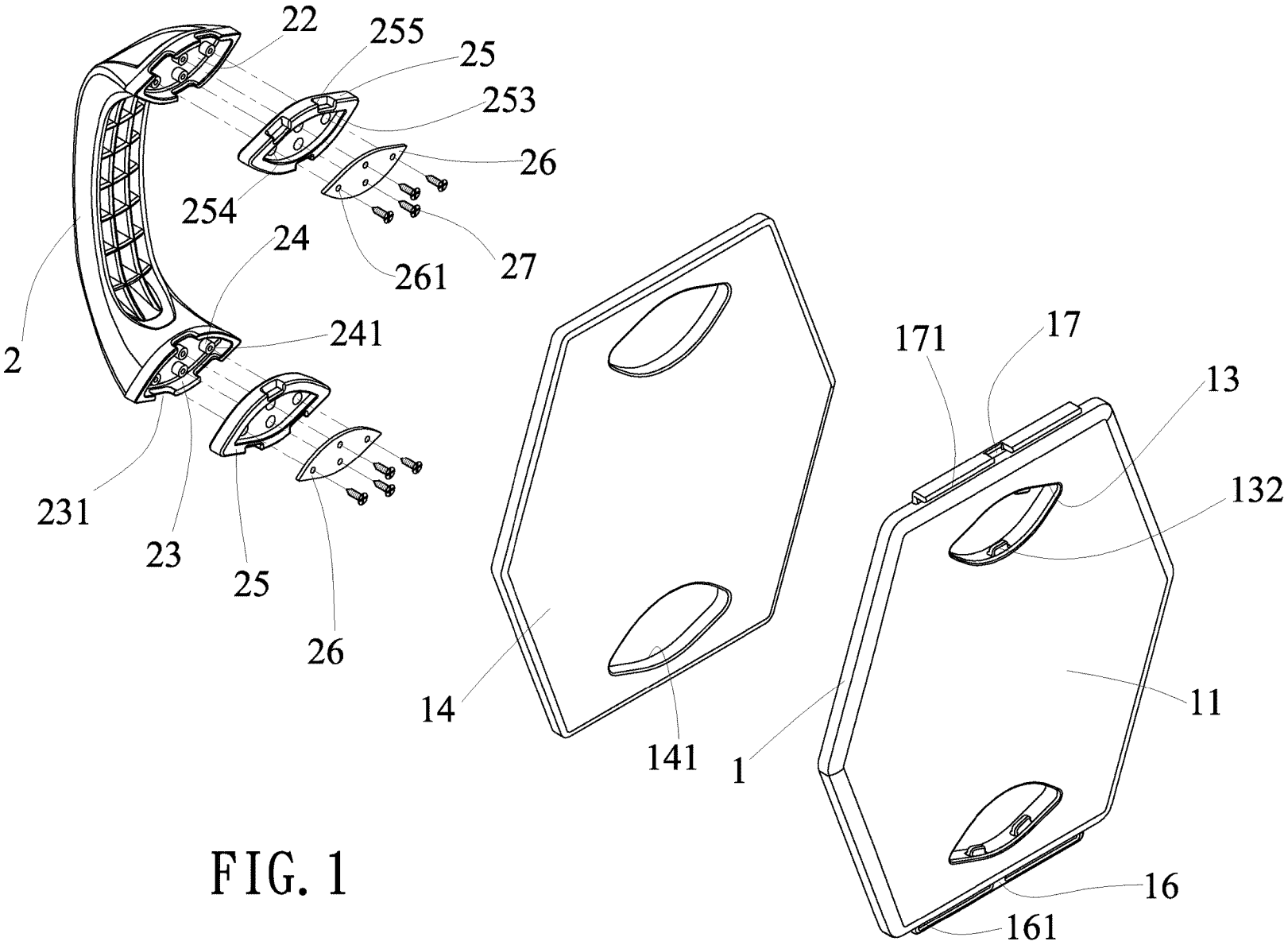
FIG. 1 is a first exploded diagram showing an exercise slider of the present invention.
Figure 2:
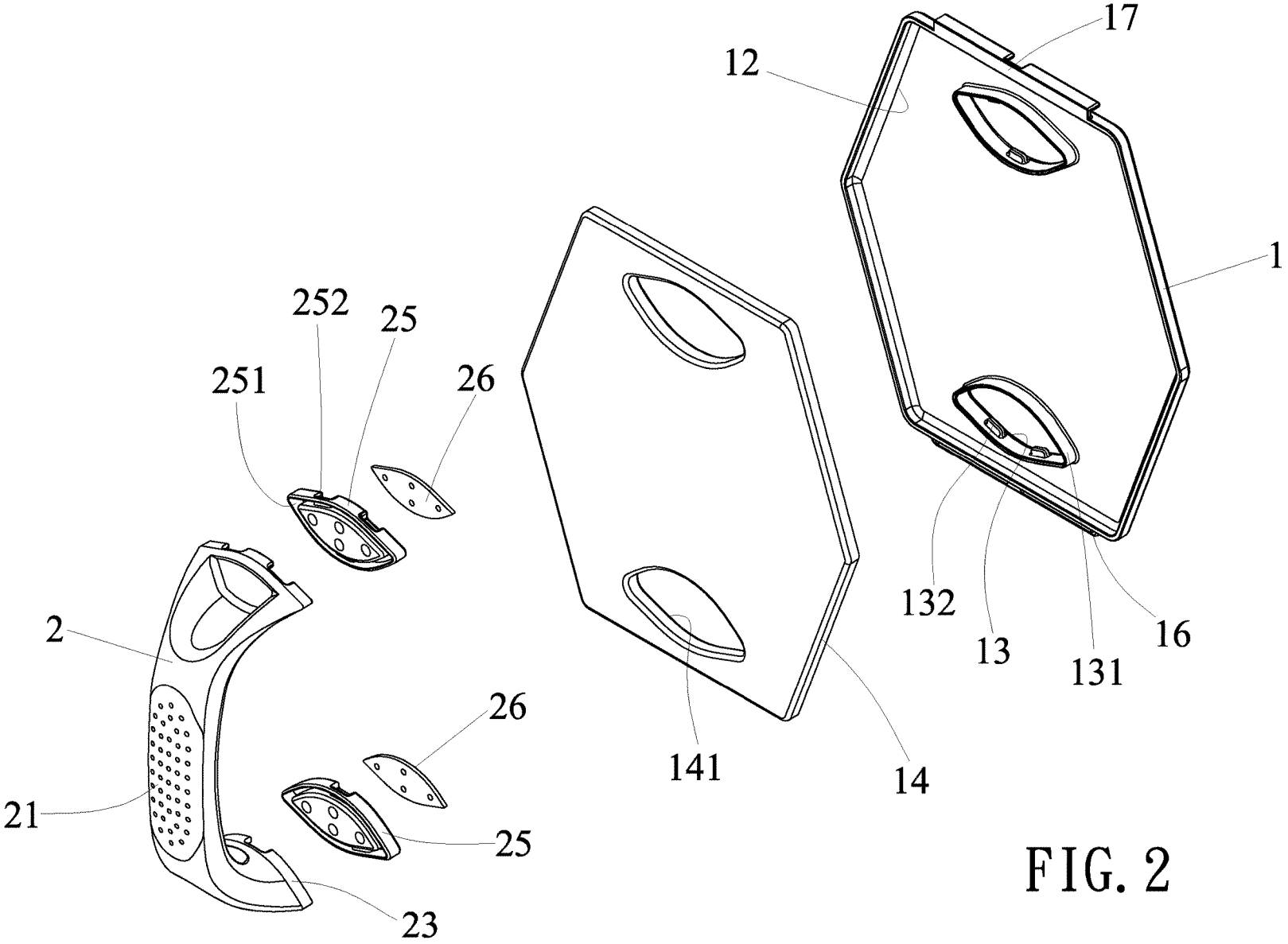
FIG. 2 is a second exploded diagram showing an exercise slider of the present invention.
Figure 3:
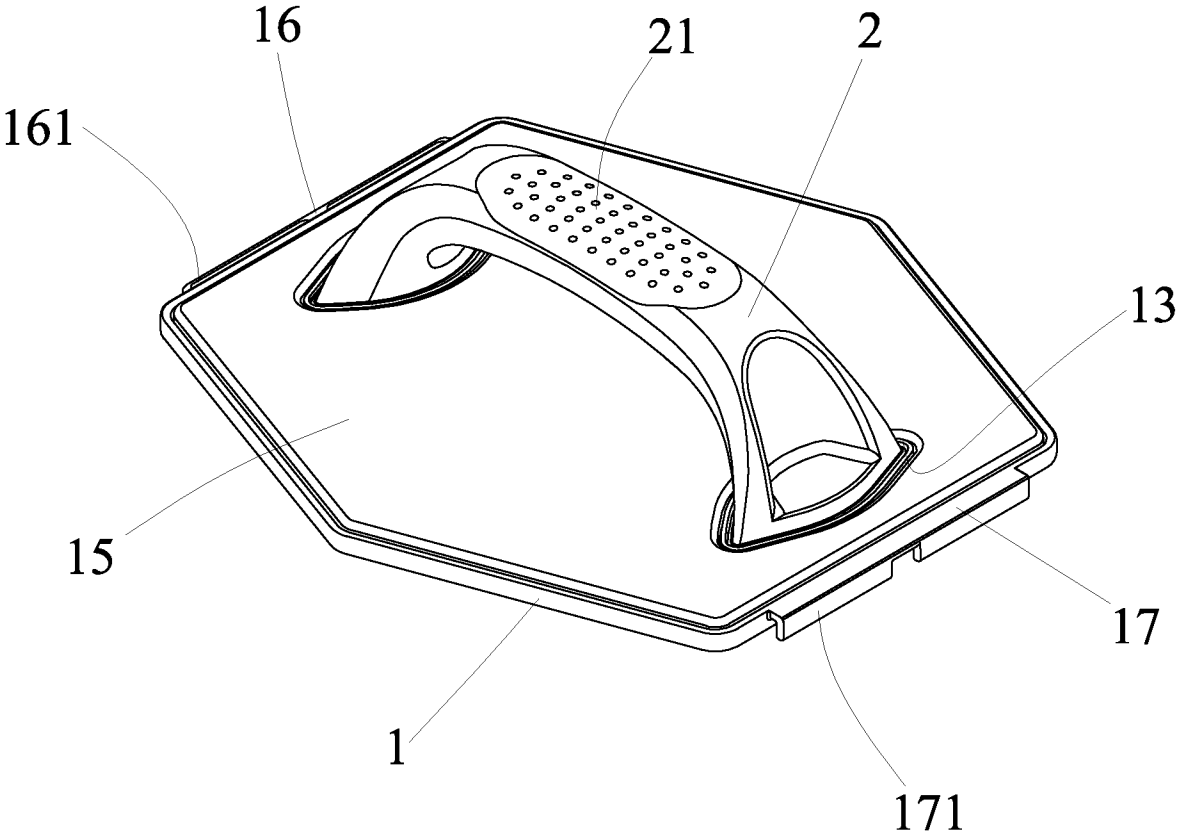
FIG. 3 is a stereogram showing an exercise slider of the present invention.
Figure 4:
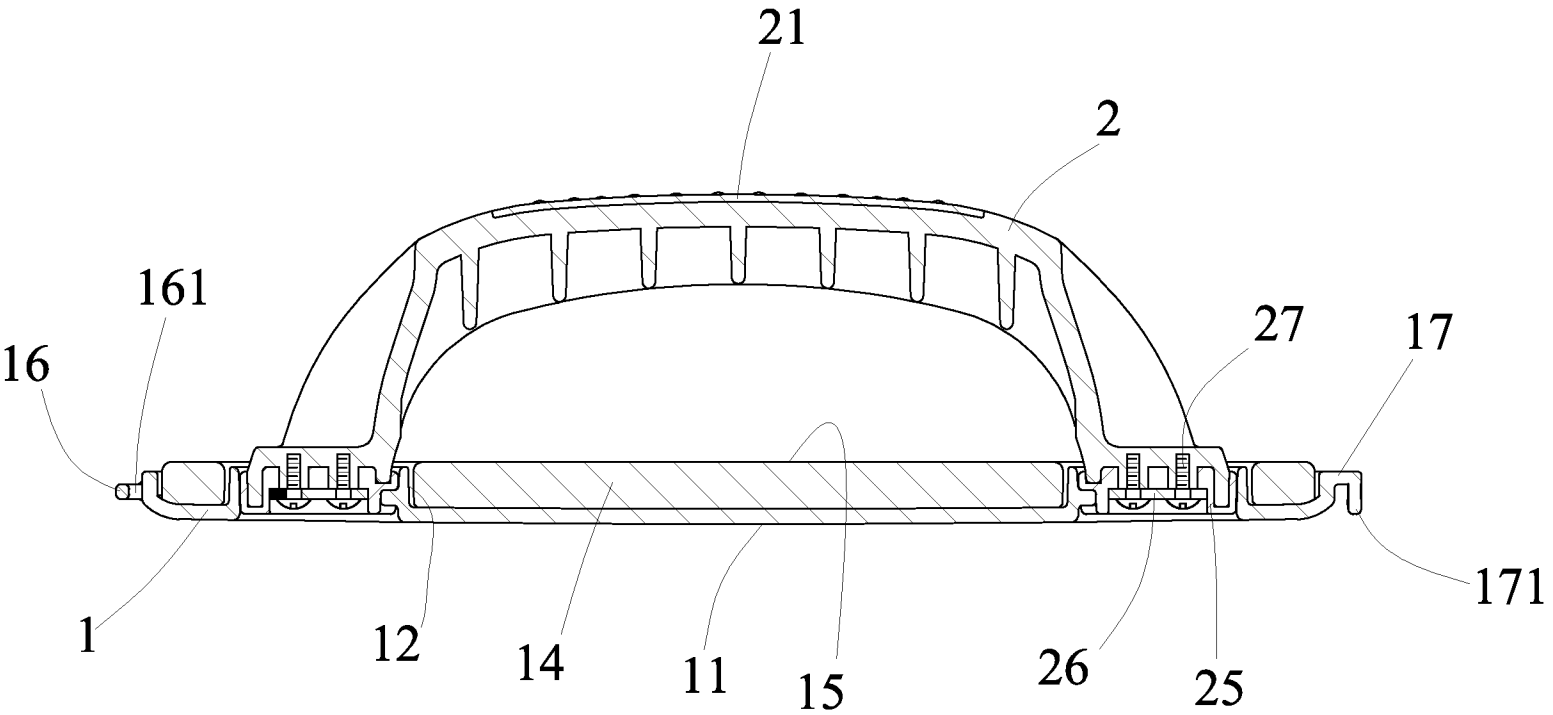
FIG. 4 is a sectional view showing an exercise slider of the present invention.

To provide a thorough understanding, the purpose and advantages of the present invention will be described in detail with reference to the accompanying drawings.

Please refer to FIG. 1 to FIG. 4, an exercising slider of the present invention is disclosed, comprises a disc body (1) and a handgrip (2).

The disc body (1) appears as a hexagonal shape, has a first end surface and a second end surface opposite to the first end surface in which the first end surface is defined as a smooth surface (11).

The disc body (1) further comprises a first recess (12) on the second end surface, two assembly holes (13) disposed at a bottom of the first recess (12) for passing through the first end surface, and a rough disc (14) assembled to the first recess (12) on the second end surface to form a rough surface (15). The rough disc (14) can be made of a flannel or a mutispandex. Each of the two assembly holes (13) at the bottom of the first recess (12) is provided with a protruding rim (131) along a periphery, and the rough disc (14) has two through holes (141) corresponding to the two assembly holes (13) of the disc body (1) for assembling to the protruding rim (131) of the two assembly holes (13). In addition, each of the two assembly holes (13) of the disc body (1) is provided with plural positioning blocks (132) on a wall thereof. The disc body (1) is provided with a first connecting portion (16) and a second connecting portion (17) respectively on at least two corresponding laterals, and the first connecting portion (16) has at least one mortise (161) and the second connection portion (17) has at least one tenon (171) for correspondingly engaging with the at least one mortise (161).

The handgrip (2) has an arched shape and an anti-slip portion (21) in a middle of the handgrip (2). The handgrip (2) has two terminals and each of two terminals is provided with a second recess (22), a protruding margin (23) formed on a periphery of the second recess (22) and having plural engaging concave portions (231), plural locking columns (24) at a bottom of the second recess (22) and each having a first locking hole (241) at a center, an anti-slip mat (25) made of a rubber material, a fixing sheet (26) having plural second locking holes (261), and plural locking members (27). The anti-slip mat (25) has a first surface, a second surface opposite to the first surface, and an engaging groove (251) disposed along a periphery of the first surface for correspondingly engaging with the protruding margin (23) of the handgrip (2). The anti-slip mat (25) is provided with plural engaging protruding portions (252) in the engaging groove (251) to engage with the plural engaging concave portions (231) of the protruding margin (23). The second surface of the anti-slip mat (25) is further provided with a fixing recess (253) disposed for accommodating the fixing sheet (26), and plural third locking holes (254) at a bottom of the fixing recess (253) for corresponding to the plural second locking holes (261) of the fixing sheet (26). Each of the plural locking members (27) passes through one of the third locking holes (254) of the anti-slip mat (25) and one of the second locking holes (261) of the fixing sheet (26) for locking to the first locking hole (241) of each of the plural locking columns (24) respectively to fix the anti-slip mat (25) to each of the two terminals of the handgrip (2). In addition, the second surface of the anti-slip mat (25) is provided with plural positioning concave portions (255) along a periphery thereof, and each of the two terminals of the handgrip (2) is inserted into each of the two assembly holes (13) of the disc body (1) for engaging the plural positioning concave portions (255) of the anti-slip mat (2) with the plural positioning blocks (132) of each of the two assembly holes (13) for positioning.

Accordingly, in use of the present invention, the smooth surface (11) or the rough surface (15) of the disc body (1) is attached to a floor according to a status of the floor to generate friction in need. For example, if the floor is a hard floor as a wooden floor or a tile floor, the rough surface (15) of the disc body (1) is used to attach the floor; and if the floor is covered with a carpet, the smooth surface (11) of the disc body (1) is used to attach the floor. Therefore, a proper friction in need between the disc body (1) and the floor can make the present invention slide stably on different types of floor.

Figure 5:
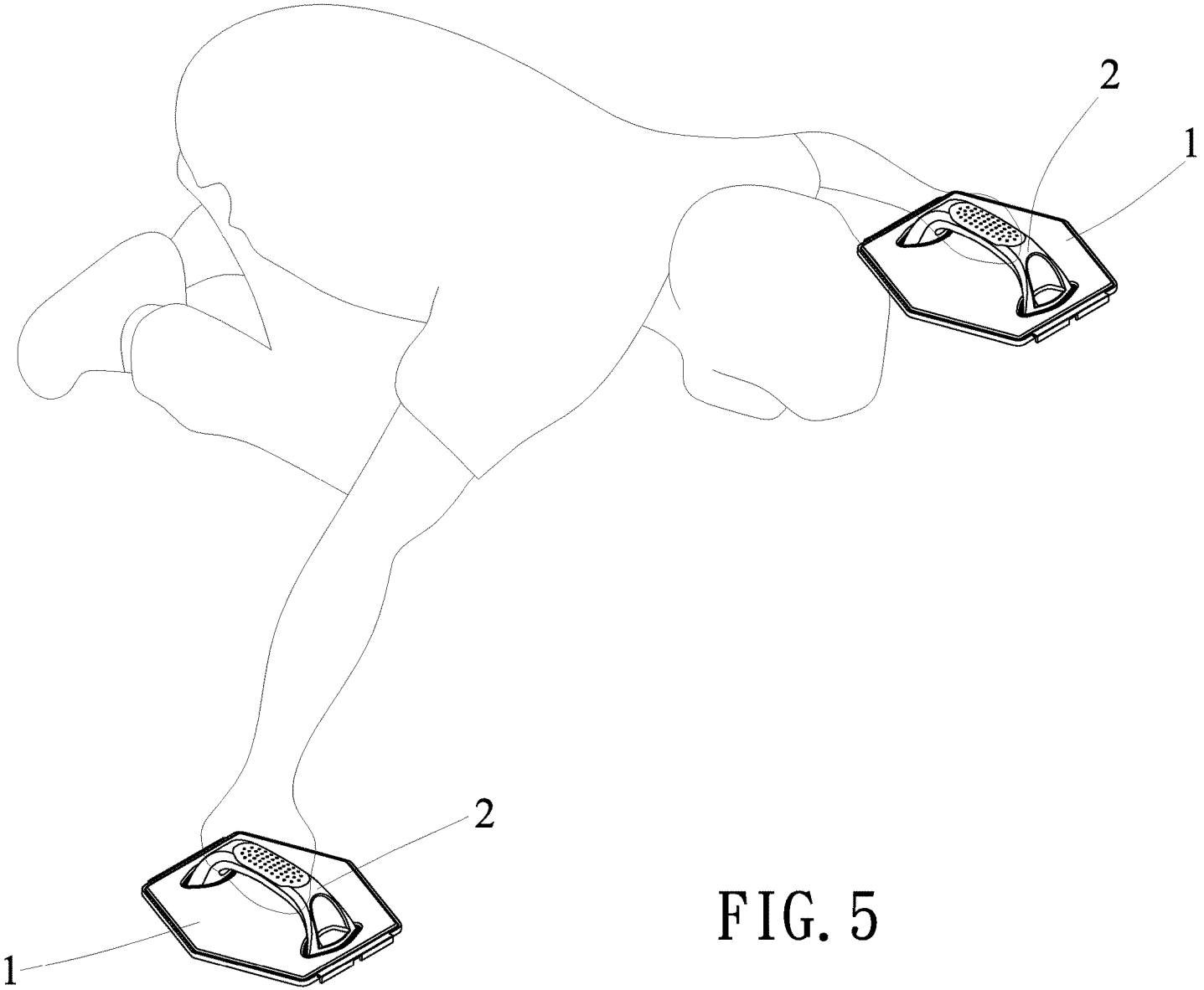
FIG. 5 is a first schematic diagram showing an exercise slider of the present invention in use.
Figure 6:
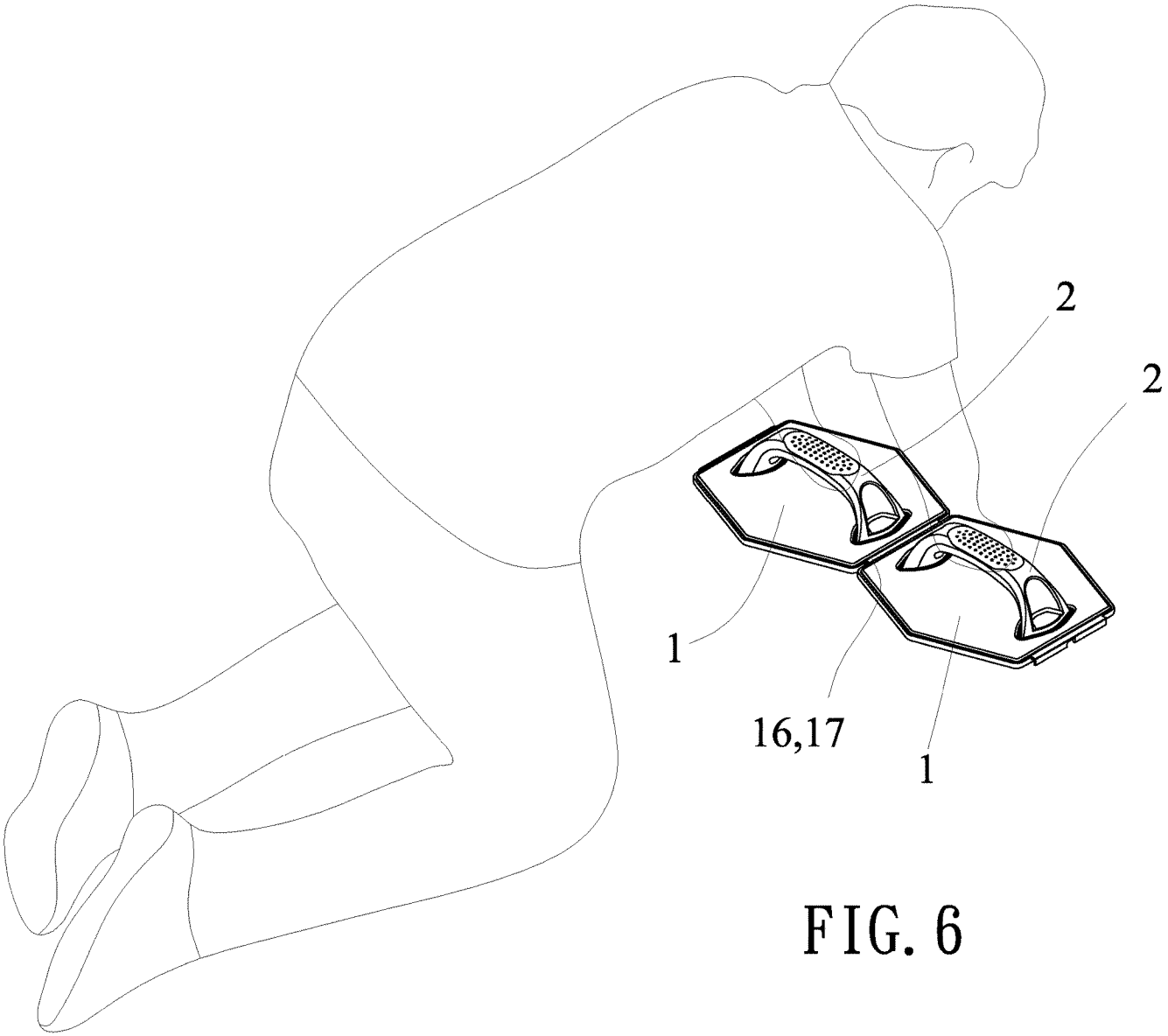
FIG. 6 is a second schematic diagram showing an exercise slider of the present invention in use.
Figure 7:
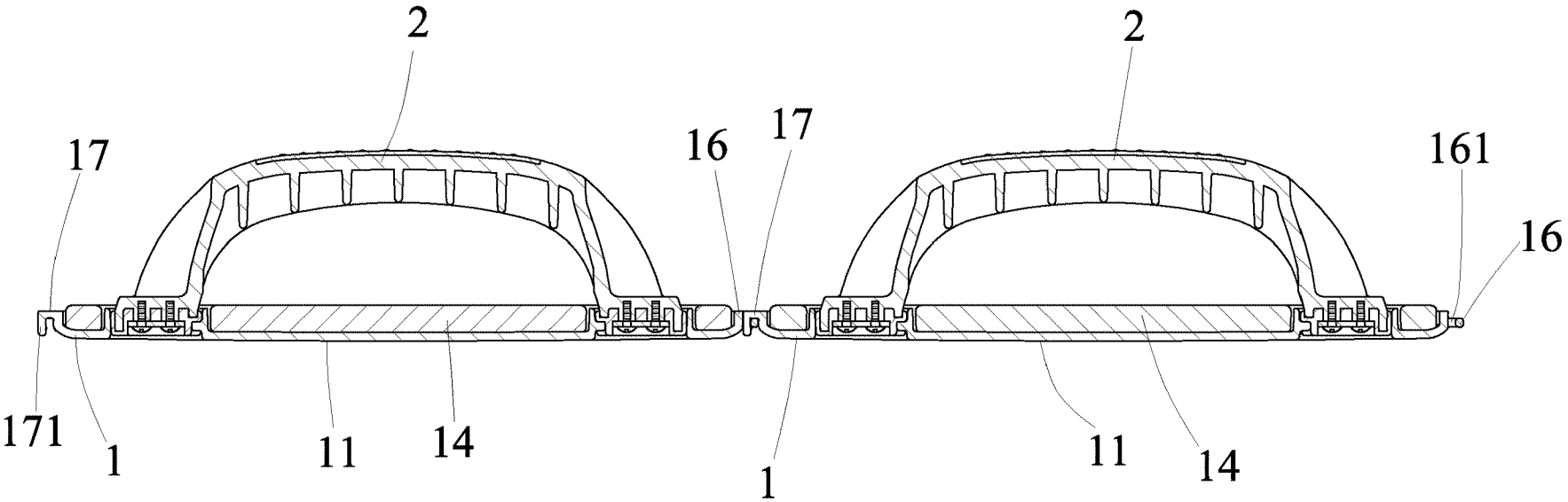
FIG. 7 is a sectional view showing the exercise slider of the present invention in use in FIG. 6.
Figure 8:
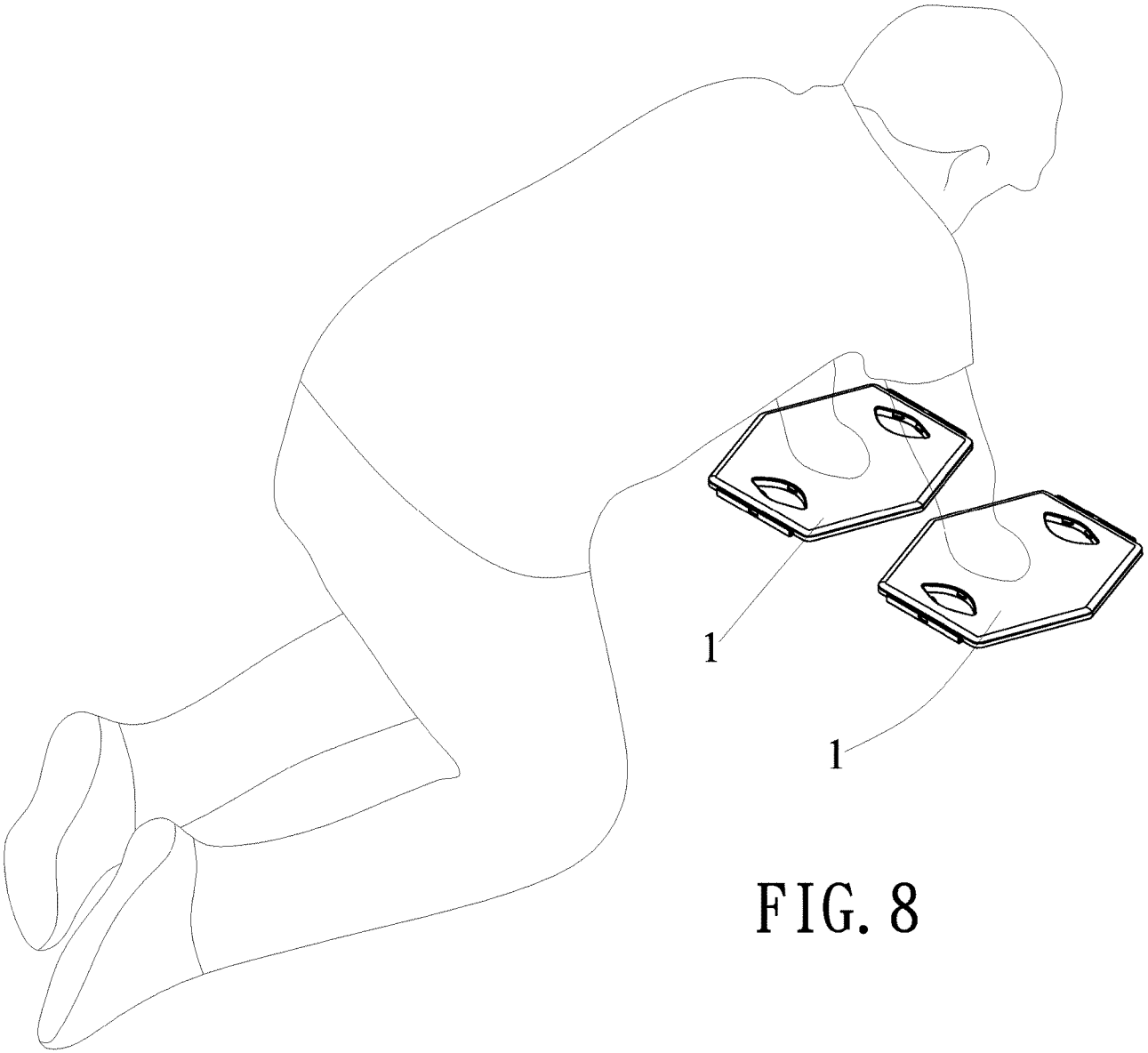
FIG. 8 is a third schematic diagram showing an exercise slider of the present invention in use.
Figure 9:
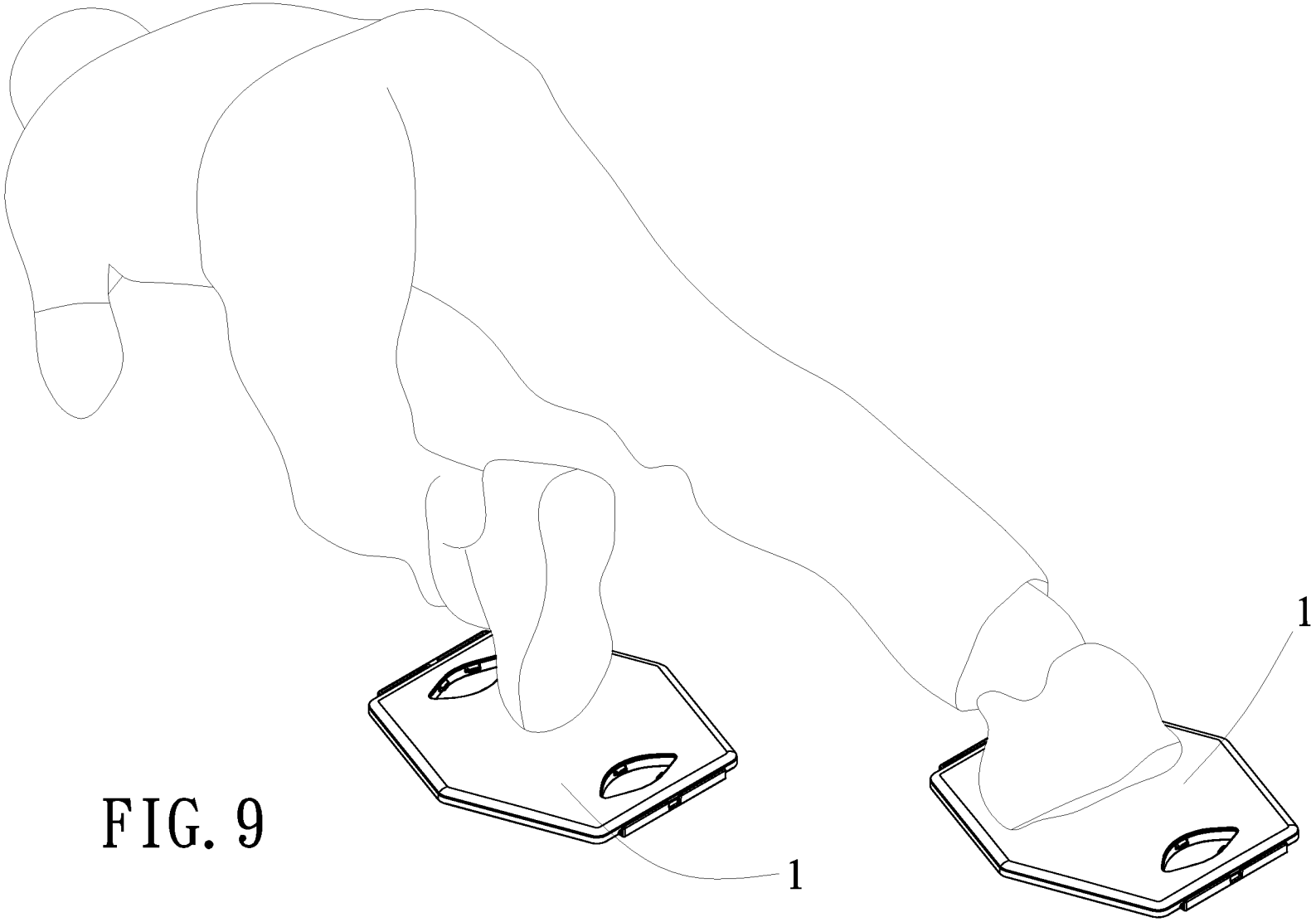
FIG. 9 is a forth schematic diagram showing an exercise slider of the present invention in use.
Figure 10:
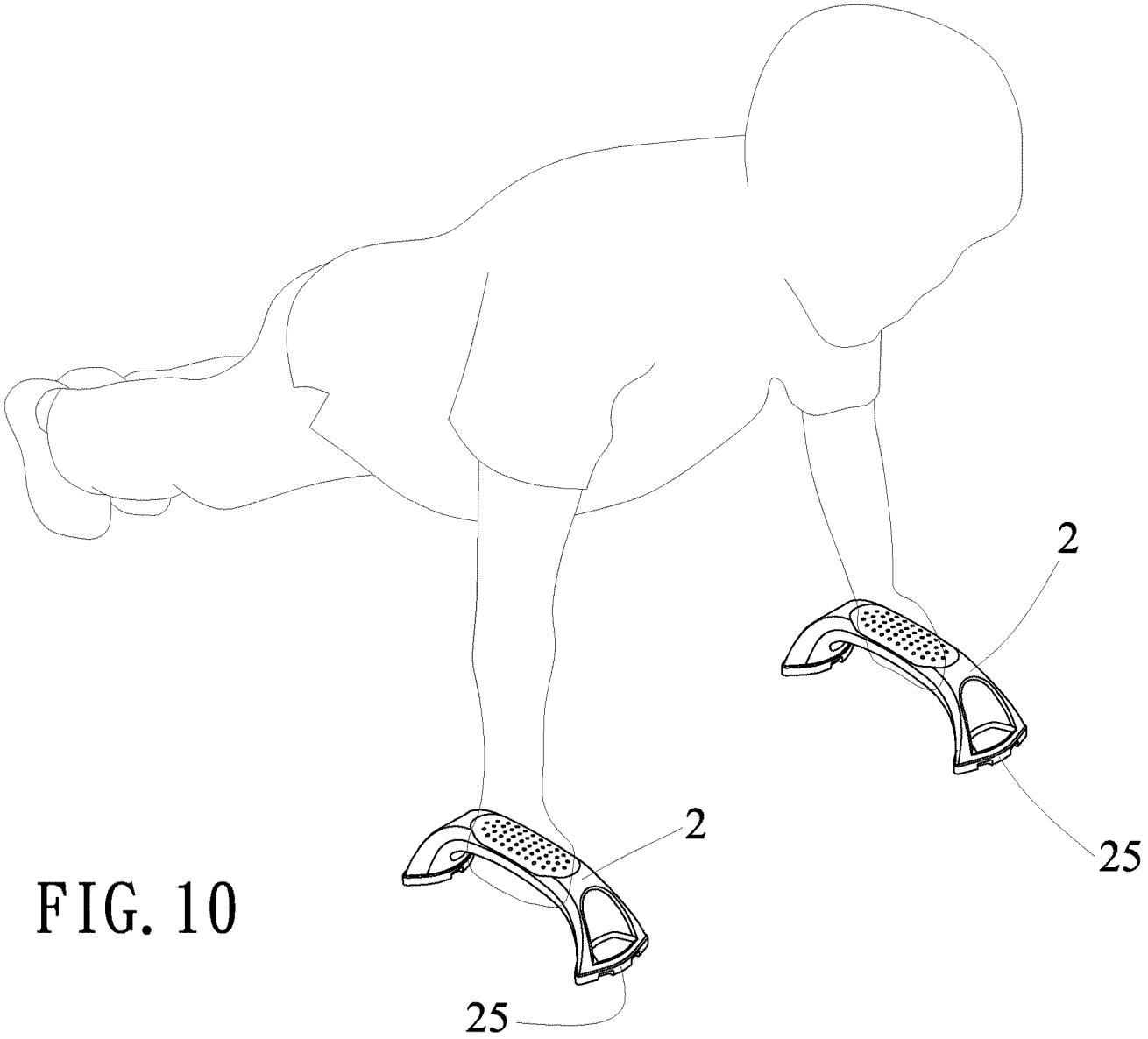
FIG. 10 is a fifth schematic diagram showing an exercise slider of the present invention in use.

Furthermore, various parts of muscles of a user can be trained by utilizing various training modes of the present invention. As shown in FIG. 5, when training upper body muscles, the user kneels on the ground and holds the handgrip (2) engaged to the disc body (1) by each hand, and the two disc body (1) on the floor are sliding left and right simultaneously by the two arms of the user to exercise chest muscle, arm muscle and upper abdomen muscles. Please refer to FIG. 6 and FIG. 7, the mortise (161) of the first connection portion (16) of one disc body (1) is engaged to the tenon (171) of the second connection portion (17) of another disc body (1) correspondingly for assembling the two disc bodies (1); the user knells on the floor and holds the two handgrip (2) of the two disc bodies (1) to slide the two disc bodies (1) forth and back on the floor by moving the user's two arms forth and back simultaneously. In addition, referring to FIG. 8, the handgrip (2) is separated form the disc body (1) and two disc bodies (1) are pressed by two hands of the user respectively to slide the two disc bodies (1) on the floor which achieves effects of upper abdomen muscles training. Referring to FIG. 9, the user is lying on the floor and supporting the user's body by two arms, and each of the user's feet is stepping on one disc body (1) having no handgrip (2) on it to slide the disc body (1) forth and back on the floor and stretch the user's legs forth and back for training lower body muscles as leg muscles, thigh muscles and hip muscles. Please refer to FIG. 10, the handgrip (2) can be separated from the disc body (1) and attached to the floor by the two anti-slip mats (25) on two terminals, and the user can perform push-ups exercise safely by holding the handgrips (2) attaching to the floor due to friction generated between the anti-slip mats (25) and the floor.

Accordingly, the exercise slider of the present invention provides various training modes for exercising muscles of various part of the user's body such as arms, chest, abdomen, legs and hip and has effects on body shaping. In addition, the user can burn excess calories and achieve exercise efficiency as aerobic exercise by sliding the two disc body (1) of the present invention on the floor repeatedly.

Furthermore, the handgrip (2) can be separated from the disc body (1) and the two disc bodies (1) can be piled up for storage which is convenient and space-saving.

According to the structures and embodiments above, the present invention has advantages as:

1. The exercise slider of the present invention has a smooth surface and an opposite rough surface, and the smooth surface or the rough surface is attached to the floor according to a status of the floor for generating a proper friction and providing a stably sliding movement on the floor; and thus the present invention achieves a safety exercise effect.

2. The exercise slider of the present invention has a handgrip having two terminals and two anti-slip mats on the two terminals respectively, and a proper friction is generated when the handgrip is attached to the floor by the two anti-slip mats on the two terminals which can provide safety and stably exercise effects for a user doing push-ups exercise.

3. The exercise slider of the present invention can provide various training modes by a single device to achieve effects of exercising various parts muscles of the body, shaping body curve and burning excess calories as aerobic exercise.

4. The exercise slider of the present invention has a simple structure, an inexpensive price and a small size, and is easily disassembled and piled up for storage; the user can exercise more conveniently without limitation of time and space when using the present invention.

What is claimed is:

1. An exercise slider, comprising:

a disc body having a smooth surface on one side, a rough surface on the other side, and two assembly holes respectively disposed on the smooth surface and the rough surface for corresponding to each other; and a handgrip detachably connected to the two assembly holes of the disc body by two terminals thereof respectively;

wherein each of the two terminals of the handgrip is provided with a second recess, a protruding margin formed on a periphery of the second recess, plural locking columns at a bottom of the second recess and each having a first locking hole at a center thereof, an anti-slip mat, a fixing sheet having plural second locking holes, and plural locking members, wherein the anti-slip mat has a first surface, a second surface opposite to the first surface, an engaging groove disposed along a periphery of the first surface for correspondingly engaging with the protruding margin of the handgrip, a fixing recess disposed on the second surface for accommodating the fixing sheet, and plural third locking holes at a bottom of the fixing recess for corresponding to the plural second locking holes of the fixing sheet, and wherein each of the plural locking members passes through one of the second locking holes of the fixing sheet and one of the third locking holes of the anti-slip mat for locking to the first locking hole of each of the plural locking columns respectively to fix the anti-slip mat to each of the two terminals of the handgrip.

2. The exercise slider as claimed in claim 1, wherein the disc body includes a first end surface defined as the smooth surface, a second end surface opposite to the first end surface, a first recess on the second end surface, the two assembly holes disposed at a bottom of the first recess for passing through the first end surface, a rough disc having two through holes corresponding to the two assembly holes of the disc body for assembling to the first recess on the second end surface to form the rough surface.

3. The exercise slider as claimed in claim 2, wherein the first recess of the disc body is provided with a protruding rim along a periphery of each of the two assembly holes at the bottom thereof for correspondingly assembling to each of the two through holes of the rough disc.

4. The exercise slider as claimed in claim 1, wherein each of the two assembly holes of the disc body is provided with plural positioning blocks on a wall thereof, and each of the two terminals of the handgrip is provided with plural positioning concave portions along a periphery thereof for respectively engaging with the plural positioning blocks for positioning.

5. The exercise slider as claimed in claim 1, wherein the anti-slip mat at each of the two terminals of the handgrip is provided with plural positioning concave portions along a periphery thereof, and each of the two assembly holes of the disc body is provided with plural positioning blocks on a wall thereof for respectively engaging with the plural positioning concave portions of the anti-slip mat for positioning.

6. The exercise slider as claimed in claim 1, wherein the protruding margin on each of the two terminals of the handgrip is provided with plural engaging concave portions, and the anti-slip mat is provided with plural engaging protruding portions in the engaging groove of the first surface to engage with the plural engaging concave portions of the protruding margin.

7. The exercise slider as claimed in claim 1, wherein the disc body is provided with a first connecting portion and a second connecting portion respectively on at least two corresponding laterals, and wherein the first connecting portion has at least one mortise and the second connection portion has at least one tenon for correspondingly engaging with the at least one mortise.

8. The exercise slider as claimed in claim 1, wherein the handgrip has an arched shape and an anti-slip portion in a middle thereof.

* * * * *